US005179405A

United States Patent [19]

Osada et al.

[11] Patent Number: 5,179,405

[45] Date of Patent: Jan. 12, 1993

[54] REPLENISHER SUPPLY DEVICE FOR PHOTOSENSITIVE PLANOGRAPHIC PRINTING PLATE PROCESSING APPARATUS

[75] Inventors: Keiji Osada; Katunori Hakuta; Mikio Nishiyama, all of Kanagawa, Japan

[73] Assignee: Fuji Photo Film Co., Ltd., Kanagawa, Japan

[21] Appl. No.: 691,288

[22] Filed: Apr. 25, 1991

[30] Foreign Application Priority Data

Apr. 26, 1990 [JP] Japan ..... 2-108886
Jul. 3, 1990 [JP] Japan ..... 2-174368

[51] Int. Cl.[5] ..... G03D 3/02
[52] U.S. Cl. ..... 354/324
[58] Field of Search ..... 354/324, 298, 319, 320, 354/321

[56] References Cited

U.S. PATENT DOCUMENTS 3,580,158 5/1971 Scholle ..... 137/392
4,289,092 9/1981 McChesney et al. ..... 354/317 X
4,417,799 11/1983 Mills ..... 354/304
4,780,737 10/1988 Kobayashi et al. ..... 354/322

*Primary Examiner*—Michael L. Gellner
*Assistant Examiner*—D. Rutledge
*Attorney, Agent, or Firm*—Sughrue, Mion, Zinn, Macpeak & Seas

[57] ABSTRACT

A replenisher supply device for photosensitive planographic printing plate processing apparatus, the supply device being arranged independently of each photosensitive planographic printing plate processing apparatus, which includes: a unit for opening a seal for a processing replenisher contained in each of containers; a tank for receiving the processing replenisher from the container; sensors for detecting the levels of the processing replenisher in each tank; and piping for supplying the processing replenisher from each tank to sucking inlets of processing replenisher supply pumps which are arranged in each photosensitive planographic printing plate processing apparatus body. Accordingly, the replenishers and water can be supplied to a plurality of photosensitive planographic printing plate processing apparatus by a reduced number of replenisher supply devices. In addition, when each solution level has reached its minimum level, the power supply of a replenishment controller is disconnected, thereby preventing pump failure by operating the pumps without sufficient replenishers.

10 Claims, 3 Drawing Sheets

REPLENISHER SUPPLY DEVICE FOR PHOTOSENSITIVE PLANOGRAPHIC PRINTING PLATE PROCESSING APPARATUS

BACKGROUND OF THE INVENTION

The invention relates to a replenisher supply device for photosensitive planographic printing plate processing apparatus (hereinafter referred to as "PS plate processing apparatus") which adds replenishers to the processing apparatus for processing a photosensitive planographic printing plate (hereinafter referred to as "PS plate") on which an image has been exposed.

Generally, a PS plate on which an image has been exposed is fed into a developing tank, where the surface of the plate receives a developing solution by means of spraying or the like and is developed while being rubbed by a brush, sponge, or the like. The light-sensitive layer of the non-image area of the exposed PS plate is swollen by applying developing solution containing an organic solvent and an alkaline aqueous solution. The swollen layer of the non-image area is then removed with ease by rubbing means such as a brush or sponge, leaving only the image area on the PS plate. This means that the developing solution contains, at this point of process, eluted substances such as a photosensitive substance. Further, since the developing solution is applied to the PS plate usually by means of showering when the plate passes through the developing tank, the solution is subjected not only to deterioration due to its being in contact with air, such as reduction in pH of the developing solution by dissolution of carbon dioxide gas, but also concentration due to evaporation of water from the processing solutions including the developing solution and a gum arabic solution. Once the developing solution loses its developing capability by processing a large volume of PS plates and/or the elapse of time and has finally reached its life limit, it must be replaced with a new developing solution. If the PS plates are processed beyond the limit of the developing solution, the photosensitive layer of the non-image area of PS plate remains, which may result in pint stains or instability in printing quality such as tone reproduction. To compensate for deterioration of the processing solutions caused by the processing of PS plates, the influence of carbon dioxide gas in the air, concentration of the processing solutions caused by evaporation of water, a replenisher for the developing solution, a replenisher for the gum arabic solution, and diluting water, and the like are supplied to the corresponding processing tanks.

However, in the conventional PS plate processing apparatus, each apparatus has a single replenisher supply device in the processing apparatus. As a result, when a plurality of PS plate processing apparatus are installed, a replenisher for each apparatus must be prepared and the labor for preparation operation is extremely cumbersome.

This invention has been made to overcome the above circumstances. Accordingly, an object of the invention is to provide a replenisher supply device for PS plate processing apparatus capable of simplifying preparatory and supplying work of replenishers.

SUMMARY OF THE INVENTION

To achieve the above object, the invention is applied to a replenisher supply device for photosensitive planographic printing plate processing apparatus, this device being arranged independently of each photosensitive planographic printing plate processing apparatus, the device comprising: means for opening a cap in a processing replenisher container; a tank for accommodating the processing replenisher contained in the processing replenisher container; means for detecting the levels of the processing replenisher in the tank; and piping for supplying the processing replenisher from the tank to sucking inlets of processing replenisher supply pumps which are arranged in each photosensitive planographic printing plate processing apparatus.

According to the present invention, the replenisher supply device is arranged independently of each PS plate processing apparatus, and is connected to each PS plate processing apparatus with the piping and control cables.

In the invention, the term "processing replenisher" includes treatment solutions to be added to developing solution and finisher solution (hereinafter referred to as "gum solution"), and replenishing water for dilution. Each processing replenisher, either for the developing solution or for the gum solution, may have a concentration equal to or different from that of the corresponding working solution. In case of supplying a replenisher whose concentration is higher than that of the working solution, it is preferable to dilute the replenisher with diluting water.

In the invention, each processing replenisher is contained in a container (e.g., a plastic container or a carton), and the outlet of each container is sealed by a seal such as a rubber plate or aluminum foil. The cover is opened by biasing or piercing with cover opening means that are provided with a comparatively sharp edge in order to introduce a solution from the processing replenisher container to the corresponding tank.

The invention includes tanks for receiving the replenisher from each processing replenisher container for the developing solution replenisher and one for the gum solution replenisher. Each tank must be large enough in volume to allow a plurality of processing apparatus to be replenished. The processing replenisher supply device may additionally be provided with a diluting water tank for storing diluting water from a water supply source, such as city water, to dilute replenishers whenever necessary.

In order to detect the levels of a replenisher contained in each of the developing solution and gum solution replenisher tanks, level sensors (e.g., electrodes) are installed for detecting the overflow level, replenishment start level, minimum level of the replenisher. Similar level sensors are arranged for the dilution water replenishing tank. These level sensors are connected to the control means so that alarm messages indicating level reduction, shortage of a replenisher at a replenisher addition timing, and the like are displayed on a display panel.

In the invention, piping is provided to supply the processing replenishers from the above processing replenisher storage tanks to the sucking inlets of the supply pumps of each PS plate processing apparatus. The replenisher supply device of the invention is connected to, e.g., 2 to 5 processing apparatus to supply the replenishers (the developing solution replenisher, the gum solution replenisher, and the diluting water) thereto. Thus, the piping is installed so that the replenishers can be supplied from the processing replenisher storage tanks to the sucking inlets of the supply pumps of each PS plate processing apparatus.

The replenisher supply device of the invention is provided with a diluting water tank that contains water for diluting the replenishers. The diluting water is transferred to the first developing tank, the second developing tank, and the gum processing tank through the piping and the pumps. The diluting water is also used to replenish portions of the working developing solutions in the first and second developing tanks which have been concentrated by natural evaporation.

In the invention, when the minimum level in each processing solution replenisher tank has been detected by the level detecting means, the power source for the replenishment controller located in each PS plate processing apparatus is disconnected. Accordingly, when a replenisher in the supply device is at its minimum level or less, the operation of the replenisher supply pumps arranged in each PS plate processing apparatus is prohibited, thereby preventing each replenisher supply pump from being operated uselessly.

DETAILED DESCRIPTION OF THE PREFERRED EMBODIMENTS

The invention will be described with reference to FIGS. 1 to 4.

Figure 1:
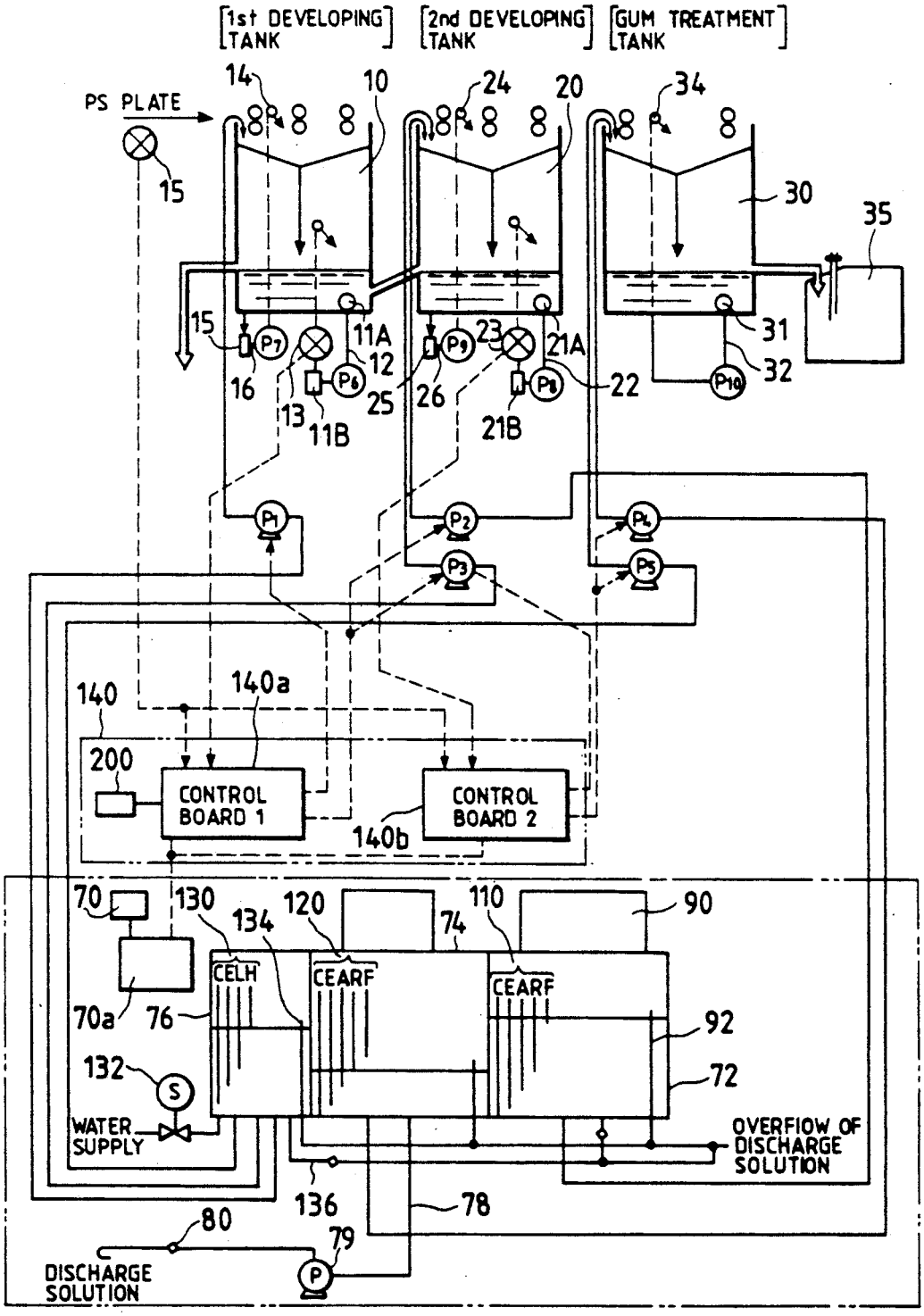
FIG. 1 is a diagram showing the relationship between the replenisher supply device for photosensitive planographic printing plate processing apparatus of the invention and one of a plurality of the photosensitive planographic printing plate processing apparatus that are connected to the replenisher supply device.

In FIG. 1, the replenisher supply device of the invention is depicted within two-dot chain line and one of the processing connected to the supply device is depicted above the supply device.

Figure 2:
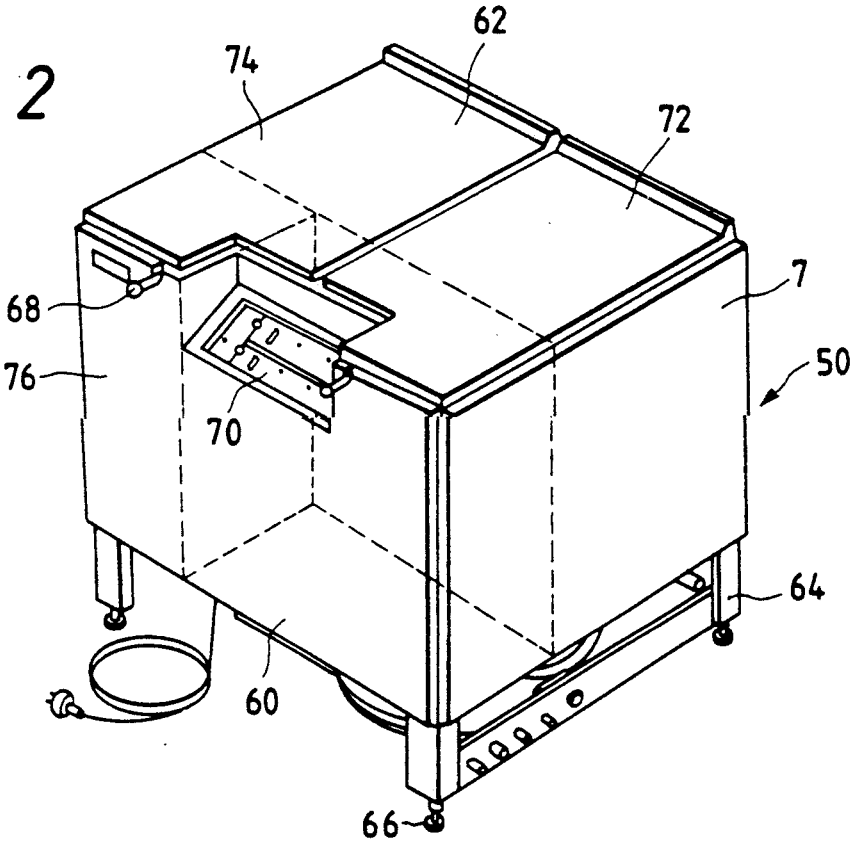
FIGS. 2 and 3 are perspective views showing the structure of the replenisher supply device of the invention.
Figure 3:
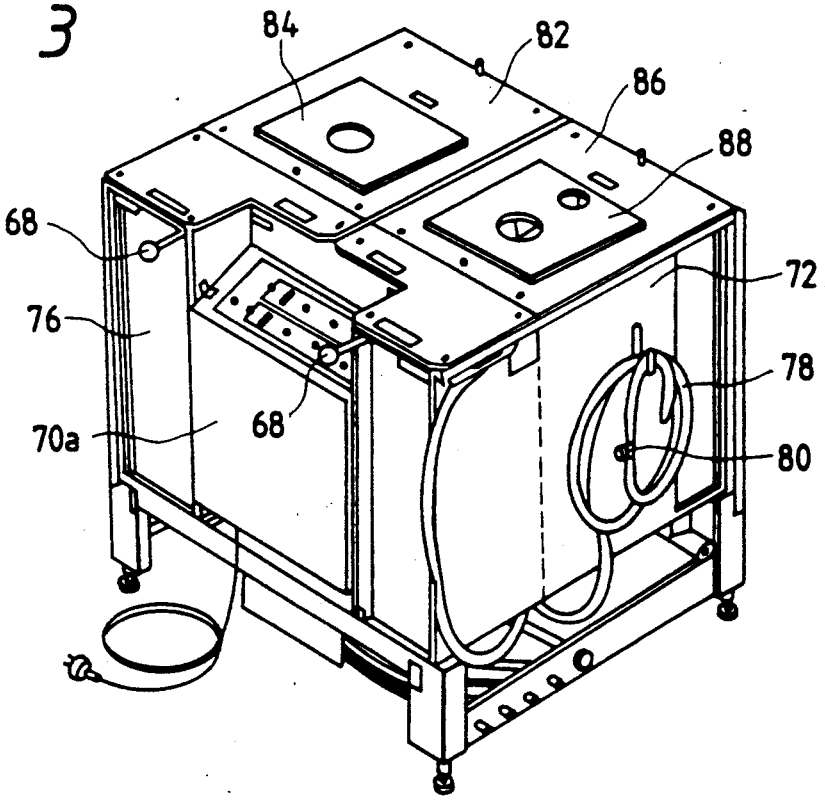

As shown in FIG. 2, a body 50 of the replenisher supply device of the invention includes a side board 60, an upper cover 62, and a bottom board (not shown), all being arranged in a substantially rectangular parallelopipedal frame. At the lower end of each of leg portion 64 is a bolt 66 for adjusting the levelness of the device. In the front of the body 50, a display panel 70 for displaying the remaining quantity of each replenisher and the like, and a piercing lever 68 projecting to open the seal of a processing replenisher container (described later) are provided. As shown in FIGS. 2 and 3, inside the replenisher supply device body 50 are a developing solution replenisher storage tank 72, a gum solution replenisher storage tank 74, a diluting water storage tank 76, a control box 70*a* that displays on the display panel 70 detected levels of replenishers within the respective replenisher storage tanks 72, 74, and 76. At the bottom of each of the respective replenisher storage tanks 72, 74, 76 is a discharge hose 78 connected in order to discharge waste solution. A discharge cock 80 is arranged on the discharge hose 78. On top of the developing solution replenisher storage tank 72 are a template 82 and a mounting plate 84, while on top of the gum solution replenisher storage tank 74 are a template 86 and a mounting plate 88 arranged similarly.

Figure 4A:
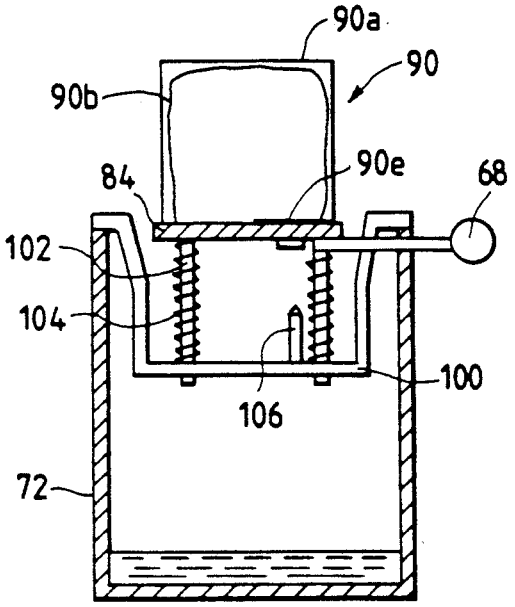
FIGS. 4A, 4B, and 4C are diagrams showing a method of opening a processing replenisher container seal of the replenisher supply device of the invention.
Figure 4B:
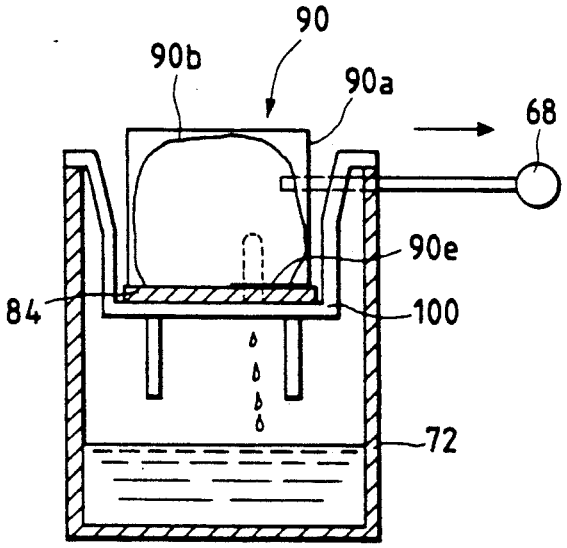
Figure 4C:
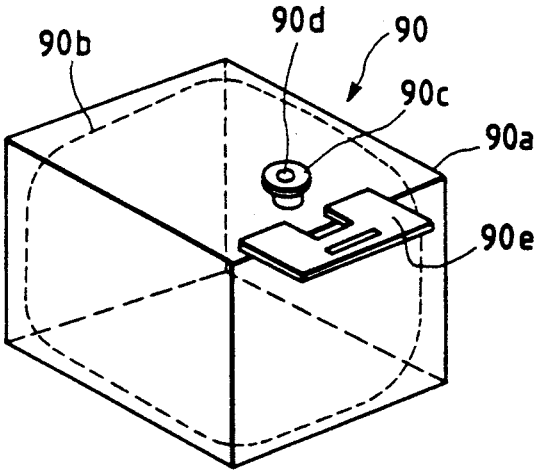

As shown in FIGS. 4A and 4B, the developing solution replenisher container 90 is made by loading a developing solution replenisher containing bag 90*b* made of a flexible plastic inside a carton box 90*a*. A cap 90*c* of the developing solution replenisher containing bag 90*b* extrudes from the opening of the carton box 90*a* as shown in FIG. 4C. The cap 90*c* has a developing solution replenisher outlet 90*d* in the middle. This outlet 90*d* is sealed by a pierceable material such as an aluminum foil or a rubber film. The developing solution replenisher container 90 is mounted on the mounting plate 84 while being placed so as to have its cap 90*c* facedown, as will be described later, so that the developing solution replenisher can be supplied to the developing solution replenisher storage tank 72. When mounting the container 90 on the mounting plate 84, the cap 90*c* must be locked into a notch on an auxiliary plate 90*e* of the container 90 lest the cap 90*c* should subside into the carton box 90*a* as a result of being pushed by the mounting plate 84.

As shown in FIGS. 4A and 4B, the mounting plate 84 is secured to the upper portion of a supporting rod 102, which is vertically movable and passes through the bottom of a replenisher container receiving member 100. A coil spring 104 is wound around the outside of the supporting rod 102. When the developing solution replenisher container 90 is not mounted on the mounting plate 84, the mounting plate is pushed upward by the repulsive force of the coil spring 104 as shown in FIG. 4A. However, when the piercing lever 68 is pulled in the direction indicated by the arrow shown in FIG. 4B, the developing solution replenisher container 90 is lowered by its own weight while overcoming the repulsive force of the coil spring 104. When it reaches a certain position, the seal of the developing solution replenisher outlet 90*d* of the developing solution replenisher container 90 is pierced by a knife edge 106 that is in the form of a hollow cylinder, and the developing solution replenisher inside the containing bag 90*b* of the developing solution replenisher container flows down into the developing solution replenisher storage tank 72. Likewise, the gum solution replenisher is sent from the gum solution replenisher container into the gum solution replenisher storage tank 74.

In the developing solution replenisher storage tank 72 is a level sensor 110 comprising a plurality of electrodes. A detection signal from each electrode is supplied to the control box 70*a*. The level sensor 110 comprises: a common electrode 110*c*, an overflow level detecting electrode 110F, an empty level detecting electrode 110E, a developing solution replenisher adding level detecting electrode 110A, and a reset electrode 110R. In the gum solution replenisher storage tank 74 is a similar level sensor 120 arranged to detect the respective levels of the gum solution replenisher. In the diluting water storage tank 76 is a level sensor 130 which consists of a solenoid valve 132 open level detecting electrode 130L and a solenoid valve 132 close level detecting electrode 130H, an empty level detecting electrode 130E, and a common electrode 130*c*.

The operation of the replenisher supply device for PS plate processing apparatus of the invention will now be described.

As shown in FIG. 1, the PS plate is sequentially introduced into a first developing tank 10, a second developing tank 20, a gum processing tank 30 for each processing step while being interposed between a plurality of pairs of feed rollers. Below the first developing tank 10 is a circulation path that includes a circulation pump P6, filters 11A, 11B, and piping 12. The end of the piping on the delivery side of the pump P6 is connected to the upper portion of the first developing tank 10 so that the developing solution sucked from the bottom of the first developing tank 10 can be circulated under temperature control. On the piping 12 is a sensor 13 for detecting the impedance of the developing solution.

Below the first developing tank 10 is another circulation path 16 that includes a filter 15 and a circulation pump P7. The end of the piping on the delivery side of the circulation pump P7 is connected to a spray pipe 14 that is arranged in an upper portion of the first developing tank 10 so that the developing solution sucked from the bottom of the first developing tank 10 can be sprayed onto the incoming PS plate.

Below the second developing tank 20 is a circulation path 22 similarly formed, the circulation path 22 including filters 21A, 21B and a circulation pump P8. On the circulation path 22 is a sensor 23 arranged to detect the impedance of the developing solution.

Below the second developing tank 20 is another circulation path 26 that includes a filter 25 and a circulation pump P9. The end of the piping on the delivery side of the circulation pump P9 is connected to a spray pipe 24 that is arranged on an upper portion of the second developing tank 20 so that the developing solution can be sprayed onto the incoming PS plate from the spray pipe 24. Any overflowing developing solution from the second developing tank 20 is supplied to the first developing tank 10. The PS plate fed from the second developing tank 20 is introduced to the gum processing tank 30, where the gum solution is sprayed from a spray pipe 34. Below the gum processing tank 30 is a circulation path that includes a circulation pump P10, piping 32, and a filter 31, and the gum solution is jetted out from the spray pipe 34 that is connected to the end of the piping 32 on the delivery side of the circulation pump P10. Any overflowing solution from the first developing tank 10 is introduced to waste solution piping outside the system, while the overflowing solution from the gum processing tank 30 is discharged into a waste solution storage tank 35.

Adjacent to the PS plate insertion inlet of the PS plate processing apparatus is a reflection-type photoelectric sensor (PS plate insertion detecting sensor) 15, an output of which is applied to control boards **140*a* and 140*b* of a replenishment controller 140 so that the surface area of a PS plate to be inserted into the PS plate processing apparatus can be calculated. Both the developing solution replenisher and the diluting water are added to the second developing tank 20** by driving bellows pumps $P_2$ and $P_3$ for a predetermined period of time so that the ratio of developing solution replenisher and diluting water will be 1:1 based on a calculated value using the surface area of the plate.

Bellows pumps $P_4$ and $P_5$ are operated for a predetermined period of time similarly based on this surface area calculation so that the ratio of the gum solution replenisher to the diluting water will be 1:1. The quantities of the replenisher and water are variable depending on factors such as the type of PS plate and finishing requirement. Solution replenished in this embodiment were, for development, 63 cc/m$^2$ of developing solution replenisher and 63 cc/m$^2$ of diluting water and, for gum processing, 17 cc/m$^2$ of gum solution replenisher and 17 cc/m$^2$ of diluting water.

Developing solution impedance signals detected by the impedance detecting sensor 13 of the first developing solution and the impedance detecting sensor 23 of the second developing solution are applied to the control boards **140*a*, 140*b* of the replenishment controller 140 of the PS plate processing apparatus. If the impedance is out of the prescribed range due to each developing solution being concentrated by evaporation of the water content therein, the pumps $P_1$, $P_3$ operate for a predetermined period of time to cause a predetermined quantity (e.g., 400 cc) of the diluting water to be replenished to the first developing tank 10 and/or to the second developing tank 20**. The impedance is measured at a predetermined cycle (e.g., once every 2.5 minutes).

After the PS plate has been processed as described above and the pumps $P_1$ to $P_5$ have then been activated, the levels of the solutions in the developing solution replenisher storage tank 72, the gum solution replenisher storage tank 74, and the diluting water storage tank 76 are lowered. As a result, the level sensors 110, 120, 130 detect these decreased levels. Since the operation of detecting the solution level in the gum solution replenisher storage tank 74 is the same as that of detecting the solution level in the developing solution replenisher storage tank 72, the latter operation will be described below as representative.

When the developing solution replenisher container 90 has been mounted on the mounting plate 84 and the seal of the developing solution replenisher outlet **90*d* of the cap 90*c* has been pierced by the knife edge 106, the developing solution replenisher flows down from the developing solution replenisher containing bag 90*b* into the developing solution replenisher storage tank 72. If the solution level exceeds the overflow level during this process, the overflow level detecting electrode 110F detects such condition, causing the detection signal to indicate that the solution level has exceeded the overflow level on the display panel 70 through the control box 70*a* of the replenisher supply device. At the same time, the superfluous developing solution replenisher is discharged outside the system from an overflow pipe 92. When the PS plate is inserted and a detection signal from the PS plate insertion detecting sensor 15 causes the pump $P_2$ to operate for replenishment. If the solution level in the developing solution replenisher storage tank 72 is lowered to reach the lower limit of the developing solution replenisher addition level detecting electrode 110A, this detection signal causes the display panel 70 to indicate the message "REPLENISH." When an operator adds replenisher by mounting the developing solution replenisher container 90 on the mounting plate 84, the solution level is elevated again, exceeding the lower limit of the reset electrode 110R and thus allowing the PS plate to be processed continuously thereafter. If the PS plate processing is continued without mounting the developing solution replenisher container 90, the solution level will be lowered further. As the solution level reaches the lower limit of the empty level, detecting electrode 110E to issue a detection signal, such detection signal causes the display panel 70 to display a message "EMPTY." When the diluting water has been replenished by the operation of the pump $P_3$ in a quantity equal to that of the developing solution replenisher added by the operation of the pump $P_2$ and impedances in excess of the prescribed range have been detected by the impedance detecting sensors 13, 23, the diluting water is replenished by the operation of the pumps $P_1$, $P_3$. When the water level in the diluting water storage tank 76 has reached the lower limit of the solenoid valve open level detecting electrode 130L, the solenoid valve 132 is opened and water is supplied to the diluting water storage tank 76 from the water supply source. When the level in the diluting water storage tank 76 has reached the lower limit of the solenoid valve close level detecting electrode 130H, the solenoid valve 132 is closed. When the water level has exceeded a predetermined height, the water overflows outside the system from an overflow pipe 134. At the bottom of the diluting water tank is a discharge pipe 136 that is connected through a cock so that the water within the tank 76** can be discharged therefrom.

The structure and operation of the gum solution replenisher storage tank 74 are substantially the same as those of the developing solution replenisher storage tank 72. At the bottom of the gum solution replenisher storage tank 74 is piping 78 connected through a cock 80 and a pump 79 so that the waste gum solution can be discharged therefrom. As described previously, a plurality of PS plate processing apparatus are connected to the replenisher supply device of the invention. When any one of the empty level detecting electrode 110E of the developing solution replenisher storage tank 72, the empty level detecting electrode 130E of the diluting water storage tank 76, or the empty level detecting electrode 120E of the gum solution replenisher storage tank 74 has detected an empty level in the corresponding tank that an alarm is displayed on the display panel 70 with a simultaneous application of the detection signal to the replenishment controller 140 of each processing apparatus through the control box **70*a* of the replenisher supply device. As a result, a replenishment controller power switch 200 of the replenishment controller 140** of each PS plate processing apparatus is disconnected. Accordingly, the replenishing pumps $P_1$, $P_2$, $P_3$, $P_4$, $P_5$ are not operated in the absence of sufficient replenishing solution, so that air is not sucked or discharged.

The use of the replenisher supply device for photosensitive planographic printing plate processing apparatus of the invention allows the replenishers and water to be supplied to a plurality of photosensitive planographic printing plate processing apparatus, thereby contributing to significantly reducing the number of replenisher supply devices, which in the conventional art were required as many as the number of the processing apparatus. In addition, when any solution level in the replenisher supply device has reduced to reach such a level as not to allow each processing apparatus to be operated any more, the power supply of the replenishment controller arranged in the processing apparatus is disconnected, thereby preventing pump failure caused by operating the pumps without sufficient replenishers.

What is claimed is:

1. A supply device for supplying a plurality of replenisher solutions from respective containers to a plurality of photosensitive planographic printing plate processing apparatuses, said supply device being disposed independently of each of said plurality of photosensitive planographic printing plate processing apparatuses, said supply device comprising:

means for opening a seal of each of said containers of said replenisher solutions;

a plurality of tanks, one for each of said replenisher solutions, for receiving respective ones of said replenisher solutions contained in said containers;

level detecting means provided in each of said plurality of tanks for detecting levels of each of said replenisher solutions contained in each of said plurality of tanks; and piping for supplying said replenisher solutions from said plurality of tanks to sucking inlets of respective replenisher supply pumps arranged in each of said plurality of photosensitive planographic printing plate processing apparatuses.

2. The supply device according to claim 1, wherein, when said level detecting means detects a lower limit of a level of one of said replenisher solutions in one of said plurality of tanks, a power source for a replenishment controller arranged in each of said plurality of photosensitive planographic printing plate processing apparatuses is disconnected.

3. The supply device as claimed in claim 1, wherein each of said containers is composed of a flexible material, and the seal of each of said containers is made of a rubber plate or aluminum foil.

4. The supply device as claimed in claim 1, further comprising display means for displaying alarm messages indicating level reduction, shortage of each of said replenisher solutions, or replenishing timing in response to detections of said level detecting means.

5. The supply device according to claim 1, wherein said level detecting means detects levels of each of said replenisher solutions contained in each of said plurality of tanks including an overflow level, a replenishment start level, and a minimum level.

6. A photosensitive planographic printing plate processing apparatus including a plurality of photosensitive planographic printing plate processing devices having a supply device disposed independently of each of said plurality of photosensitive planographic printing plate processing devices for supplying a plurality of replenisher solutions from respective containers to said plurality of photosensitive planographic printing plate processing devices, said supply device comprising:

means for opening a seal of each of said containers of said replenisher solutions;

a plurality of tanks, one for each of said replenisher solutions, for receiving respective ones of said replenisher solutions contained in said containers;

level detecting means provided in each of said plurality of tanks for detecting levels of each of said replenisher solutions contained in each of said plurality of tanks; and piping for supplying said replenisher solutions from said plurality of tanks to sucking inlets of respective replenisher supply pumps arranged in each of said plurality of photosensitive planographic printing plate processing devices.

7. The photosensitive planographic printing plate processing apparatus as claimed in claim 6, wherein, when said level detecting means detects a lower limit of a level of one of said replenisher solutions in one of said plurality of tanks, a power source for a replenishment controller arranged in each of said photosensitive planographic printing plate processing devices is disconnected.

8. The photosensitive planographic printing plate processing apparatus as claimed in claim 6, wherein each of said containers is composed of a flexible material, and the seal of each of said containers is made of a rubber plate or aluminum foil.

9. The photosensitive planographic printing plate processing apparatus as claimed in claim 6, wherein said supply device further comprises display means for displaying alarm messages indicating level reduction, shortage of said each of replenisher solutions, or replenishing timing in response to detections of said level detecting means.

10. The photosensitive planographic printing plate processing apparatus as claimed in claim 6, wherein said level detecting means detects levels of each of said replenisher solutions contained in each of said plurality of tanks including an overflow level, a replenishment start level, and a minimum level.

* * * * *